US007294183B2

(12) United States Patent
Tyvoll

(10) Patent No.: US 7,294,183 B2
(45) Date of Patent: Nov. 13, 2007

(54) ACTIVATING AGENTS FOR USE WITH REACTIVE COLORANTS IN INKJET PRINTING OF TEXTILES

(75) Inventor: David Tyvoll, La Jolla, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 96 days.

(21) Appl. No.: 10/280,342

(22) Filed: Oct. 25, 2002

(65) Prior Publication Data

US 2004/0081761 A1 Apr. 29, 2004

(51) Int. Cl.
*C09D 11/00* (2006.01)

(52) U.S. Cl. ..... 106/31.43; 106/31.47; 106/31.75; 106/31.78

(58) Field of Classification Search ..... 106/31.43, 106/31.47, 31.75, 31.78
See application file for complete search history.

(56) References Cited

U.S. PATENT DOCUMENTS 4,849,770 A * 7/1989 Koike et al. ..... 347/100
4,877,451 A * 10/1989 Winnik et al. ..... 106/31.45
5,098,475 A * 3/1992 Winnik et al. ..... 524/386
5,102,763 A * 4/1992 Winnik et al. ..... 430/108.24
5,403,358 A * 4/1995 Aston et al. ..... 8/445
5,443,630 A * 8/1995 von der Eltz et al. ... 106/31.27
5,733,363 A * 3/1998 Nagashima et al. ..... 106/31.43
5,779,780 A * 7/1998 Gregory et al. ..... 106/31.48
5,820,661 A * 10/1998 Gregory et al. ..... 106/31.48
5,897,694 A 4/1999 Woolf
5,935,309 A * 8/1999 Moffatt et al. ..... 106/31.27
6,005,022 A * 12/1999 Schwarz, Jr. ..... 523/160
6,054,505 A * 4/2000 Gundlach et al. ..... 523/160
6,059,870 A * 5/2000 Taylor et al. ..... 106/31.43
6,084,077 A * 7/2000 Kalweit ..... 534/637
6,254,231 B1 7/2001 Suzuki et al.
6,291,023 B1 9/2001 Nigam
6,293,667 B1 * 9/2001 Gregory et al. ..... 347/96
6,432,186 B1 * 8/2002 Taniguchi ..... 106/31.58
6,780,229 B2 * 8/2004 Hopper et al. ..... 106/31.43

FOREIGN PATENT DOCUMENTS

WO WO 97/20000 6/1997
WO WO 97/40108 10/1997
WO WO 98/29513 7/1998
WO WO 00/37575 6/2000
WO WO 2004/031468 4/2004

* cited by examiner

*Primary Examiner*—J. A. Lorengo
*Assistant Examiner*—Veronica Faison-Gee

(57) ABSTRACT

An inkjet ink having an increased shelf life. The inkjet ink comprises an ink vehicle and a reactive colorant. The reactive colorant is nonreactive with water,thereby increasing the shelf life of the inkjet ink to greater than approximately twelve months. An inkjet printing system comprising the inkjet ink and an activating agent is also disclosed. A reactive colorant of the inkjet ink is nonreactive with water but is sufficiently reactive with the activating agent to form an activated complex to fix the reactive colorant to a textile substrate. A method of printing on a textile substrate is also disclosed.

16 Claims, No Drawings

ACTIVATING AGENTS FOR USE WITH REACTIVE COLORANTS IN INKJET PRINTING OF TEXTILES

BACKGROUND OF THE INVENTION

1. Field of the Invention

The present invention relates to an inkjet ink having a reactive colorant that is less susceptible to hydrolysis, thereby having an improved shelf life. The reactive colorant reacts with an activating agent to fix the reactive colorant to a textile substrate.

2. State of the Art

Images are typically printed on textiles using various colorants, such as dyes or pigments. For example, when printing on textiles using an inkjet printer, the inkjet inks use acid dyes, disperse dyes, reactive dyes, or pigments as the colorants. Reactive dyes crosslink or bind to the fibers of the textile, thereby providing the desired images on the fibers. The reactive dye has a chromophore and a reactive group, such as a halotriazine or halodiazine group, which fixes the dye to the textile. In contrast, pigments are dispersed with a large amount of polymer resin, which keeps the pigment dispersed and acts as a binder to the textile. The colorants generally used to print on textiles are shipped in a dry form and reconstituted into a paste for use. The paste-like colorant is then applied to the textile to form the desired image. For example, in screen printing, the colorant is pressed through a screen to produce the desired image on the textile. Heat is then applied to set the colorant to prevent it from fading or rinsing out during washing. While this, and similar, processes of printing on textiles have been used for hundreds of years, these processes are not optimal because they require multiple steps and are time consuming.

The reliability, high print quality, and low cost of inkjet printing have provided an attractive alternative for improving the speed of printing on textiles. Therefore, inkjet inks compatible with textiles have been, and continue to be, developed. Similar to the colorants used in non-inkjet printing applications, inkjet inks use a dye or pigment as the colorant. However, the colorant is formulated in a liquid ink vehicle rather than in a paste. The colorant used in an inkjet ink also has a reactive group that reacts with the textile fibers to fix the colorant to the textile. The reactivity of the colorant depends on the reactivity of the reactive group with the textile fibers. For example, the reactivity of reactive dyes, which have a reactive group and a chromophore (or chromogen), is generally divided into three categories. Low reactivity dyes require a high temperature, generally greater than 80° C., to react with the textile fibers. Medium reactivity dyes react at 30-60° C. and high reactivity dyes react at room temperature.

One common problem with reactive dyes, especially high and medium reactivity dyes, is that the reactive group is susceptible to hydrolysis. Since inkjets inks are shipped in aqueous solutions in an inkjet pen, the reactive group will hydrolyze if the inkjet ink is not used within a certain period of time (referred to as the shelf life of the inkjet ink) or if the inkjet ink is stored at a high temperature. If the reactive group is hydrolyzed, the colorant will not effectively fix to the substrate and the color of the printed image will not be optimal.

Inkjet inks that are currently available to print on textiles are not optimal because the inkjet inks do not adhere to the textile and run, smear, or wash away with repeated use or laundering. Furthermore, pigment-based inkjet inks are generally problematic for use in inkjet printing because they have high concentrations of binder (up to 20-30%) in the inkjet ink. In addition, many of these inkjet inks do not have a sufficiently long shelf life. While inkjet inks that use pigments, acid dyes, or disperse dyes have a shelf life of multiple years, inkjet inks that use reactive dyes as the colorant have a shelf life of approximately twelve months. Therefore, inkjet inks that use reactive dyes are only useful for a time period up to about twelve months. The twelve-month time period is measured from the date of manufacture of the ink and not from the date at which the ink reaches the customer. This short shelf life imposes severe restraints on ink and pen distribution because the inkjet ink commonly degrades in the amount of time that it takes to distribute the ink to the final end customers.

BRIEF SUMMARY OF THE INVENTION

An inkjet ink having an increased shelf life is disclosed. The inkjet ink comprises an ink vehicle and a reactive colorant having at least one reactive group. The reactive group is resistant to hydrolysis, therefore increasing the overall stability and shelf life of the inkjet ink. The shelf life of the inkjet ink is greater than approximately twelve months.

An inkjet printing system used to fix a colorant to a textile substrate is also disclosed. The inkjet printing system comprises an activating agent and an inkjet ink having an ink vehicle and a reactive colorant. The reactive colorant has at least one reactive group that is resistant to hydrolysis but is sufficiently reactive to bind to the activating agent.

A method of printing on a textile substrate is disclosed. The method comprises applying an activating agent and an inkjet ink to the textile substrate. The inkjet ink comprises an aqueous ink vehicle and a reactive colorant and has a shelf life greater than approximately twelve months. The reactive colorant has at least one reactive group that is resistant to hydrolysis yet is sufficiently reactive to form a complex with the activating agent. The reaction activates the reactive group and fixes the reactive colorant to the textile substrate.

DETAILED DESCRIPTION OF THE INVENTION

An inkjet ink with an improved shelf life is disclosed. The inkjet ink is used in drop-on-demand and thermal inkjet printing. The inkjet ink includes a reactive colorant having at least one reactive group. The reactive group is poorly reactive with water and, therefore, is not susceptible to hydrolysis, even at high temperatures. Since the reactive group is resistant to hydrolysis, including high temperature hydrolysis, the overall stability and shelf life of the inkjet ink are improved. The inkjet ink is used in an inkjet printing system that has an activating agent.

The inkjet ink may include an aqueous-based ink vehicle and the reactive colorant, which is soluble in the ink vehicle. The inkjet ink may optionally include ingredients including, but not limited to, surfactants, corrosion inhibitors, pH adjusting agents, and biocides (anti-microbial agents, anti-fungal agents, etc.), depending on the desired properties of the inkjet ink. To provide optimal stability for the inkjet ink, the inkjet ink may have a pH of less than approximately 7. Preferably the pH is approximately 6 to 6.5. To provide this pH, an appropriate pH-adjusting agent or buffer may be selected. For example, 4-morpholineethanesulfonic acid ("MES"), N-(2-acetamido)-2-iminodiacetic acid ("ADA"), bis(2-hydroxyethyl)-imino-tris(hydroxymethyl)methane ("BIS-TRIS"), piperazine-N,N'-bis(ethanesulfonic acid)

("PIPES"), or 3-(N-morpholino)-2-hydroxypropanesulfonic acid ("MOPSO") may be used.

The ink vehicle may include water or a mixture of water and at least one water-soluble organic solvent. The water-soluble organic solvent may include, but is not limited to, an aliphatic alcohol, an aromatic alcohol, a diol, a glycol ether, a poly(glycol) ether, a caprolactam, a formamide, an acetamide, and a long chain alcohol, or mixtures thereof. Examples of organic solvents employed in the practice of this invention include, but are not limited to, primary alcohols of 30 carbons or less, primary aromatic alcohols of 30 carbons or less, secondary aliphatic alcohols of 30 carbons or less, secondary aliphatic alcohols of 30 carbons or less, 1,3-alkyldiols of 30 carbons or less, alkyltriols of 30 carbons or less, 1,ω-alcohols of 30 carbons or less, ethylene glycol alkyl ethers, propylene glycol alkyl ethers, poly (ethylene glycol) alkyl ethers, higher homologs of poly (ethylene glycol) alkyl ethers, poly(propylene glycol) alkyl ethers, higher homologs of poly(propylene glycol) alkyl ethers, N-alkyl caprolactams, unsubstituted caprolactams, substituted formamides, unsubstituted formamides, substituted acetamides, and unsubstituted acetamides. If a primary alcohol is used in the ink vehicle, it is preferable that the ink vehicle does not include more than one primary alcohol, such as 1,5-pentanediol. The water-soluble organic solvent may be present in a range from approximately 0.01 wt % to approximately 50 wt % of the total weight of the inkjet ink, with approximately 0.1 wt % to approximately 20 wt % being preferred.

The reactive colorant may produce a cyan, yellow, magenta, blue, green, orange, gold, turquoise, etc. or black inkjet ink, depending on the dye or pigment that is used. The reactive colorant may include a chromophoric group and a reactive group. The chromophoric group and reactive group may be directly attached to one another or may be attached through a linker or spacer group. The reactive colorant may be synthesized by conventional techniques known in the art.

If the reactive colorant is a reactive dye, the chromophoric group may be an azo, anthraquinone, pyrroline, phthalocyanine, polymethine, arylcarbonium, triphenodioxazine, benzodifuranone, or indolene group. The chromophoric group may be linked to the reactive group through a spacer, such as an imino group. Exemplary chromophores include, but are not limited to, the following compounds, where the chromophore is shown linked to the reactive group through the linker group:

Compound I

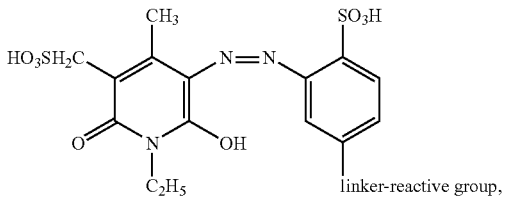

-continued

Compound II

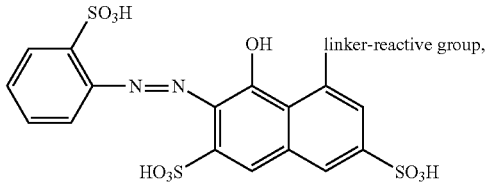

Compound III

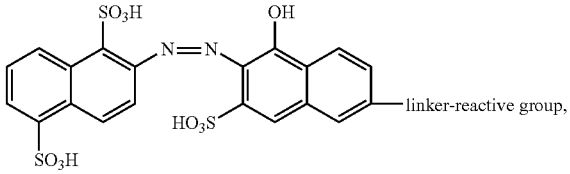

Compound IV

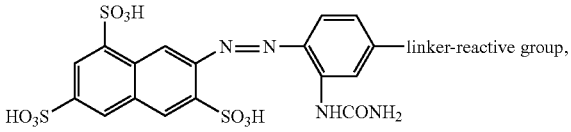

Compound V

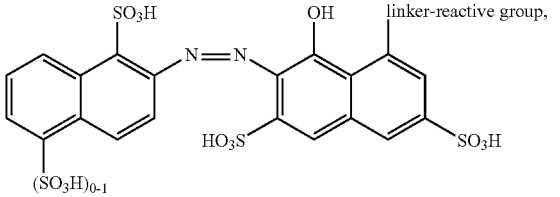

Compound VI

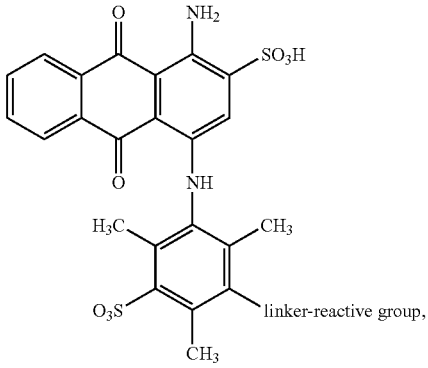

Compound VII

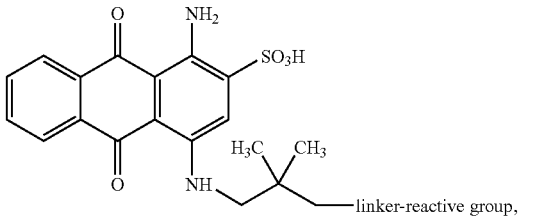

Compound VIII

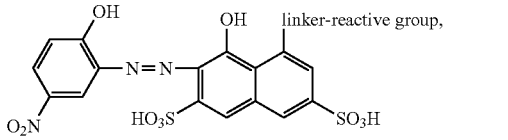

1:2 Cr complex

-continued

Compound IX

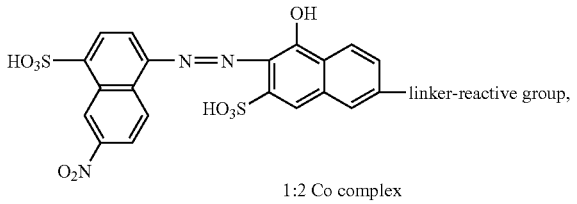

1:2 Co complex and

Compound X

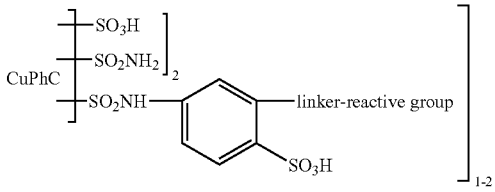

where CuPhC is a copper phthalocyanine radical. The reactive dye may include, but is not limited to, an acid dye, a direct dye, a basic dye, or a dispersive dye. The reactive dye may be present in a range of approximately 0.1% to 15% by weight of the dye based on the total weight of the inkjet ink.

The reactive group may be a chemical group or moiety that is capable of reacting with an activating agent of the inkjet printing system discussed herein. While the reactive group is of sufficient reactivity to react with the activating agent, the reactive group may be poorly reactive with water so that the reactive colorant does not hydrolyze if the inkjet ink is stored for a long period of time or is exposed to high temperatures. In other words, the reactive group may be less susceptible to hydrolysis while still exhibiting sufficient reactivity to react with the activating agent. While hydrolysis of the reactive colorant may be affected by numerous conditions, such as the formulation, temperature, and impurities of the inkjet ink, the reactive colorant may exhibit less than approximately 10% hydrolysis over a twelve month period. Preferably, the reactive colorant exhibits less than approximately 5% hydrolysis over a twelve month period. The decreased reactivity of the reactive group may increase the overall stability and shelf life of the inkjet ink. The shelf life of the inkjet ink may be increased to greater than approximately twelve months. Preferably, the shelf life of the inkjet ink is increased to between approximately eighteen to twenty-four months at room temperature.

Triazine or diazine groups may be used as the reactive group. The diazine groups may be pyrimidine, pyridazine, quinoxaline, quinazoline, or phthalazine groups. The triazine or diazine group may be substituted with at least one electron withdrawing group to make the reactive group sufficiently susceptible to reaction with a nucleophile, such as the activating agent. The electron withdrawing group may be a halogen, such as a fluoro-, chloro-, bromo-, or iodo-group. The electron withdrawing group may also be a non-halogen, such as a nitrate, a cyano, or other amino group. The desired reactivity may also be achieved by fusing rings to the triazine or diazine group. If the triazine or diazine group is substituted with more than one electron withdrawing group, the electron withdrawing groups may be the same or may be different. For example, two chloro-groups or one chloro- and one fluoro-group may be substituted on the reactive group.

As is known in the art, trihalotriazines are more reactive than mono- or di-halotriazines and trihalodiazines are more reactive than mono- or di-halodiazines. In addition, it is known that trihalopyrimidines, such as trichloropyrimidines, has approximately the same reactivity as monohalotriazines, such as monochlorotriazines. Therefore, it is preferable that the reactive group is a mono-halogenated triazine or mono- or di-halogenated diazine, or a derivative thereof. Preferably, the reactive group is a monochlorotriazine, a monofluorotriazine, a monochlorodiazine, a monofluorodiazine, a dichlorodiazine, a monofluoropyrimidine, a monochloropyrimidine, a difluoropyrimidine, a dichloropyrimidine, a trifluoropyrimidine, a trichloropyrimidine, or a derivative thereof. The reactive group may include, but is not limited to, the compounds illustrated in Table 1, where R is a substituent listed in Table 2.

TABLE 1

Monochlorotriazine and Monochlorodiazine Reactive Groups

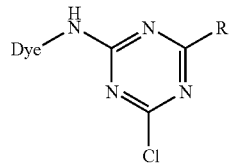

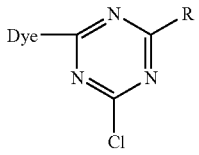

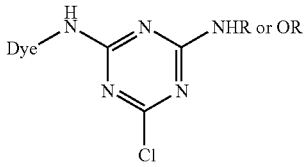

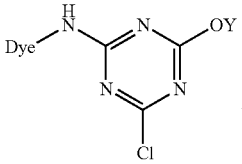

Y = alky, aryl

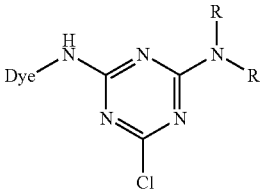

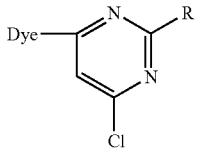

TABLE 1-continued

| Monochlorotriazine and Monochlorodiazine Reactive Groups |
|---|
| 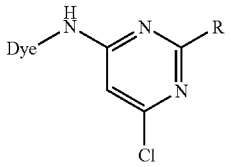 |

TABLE 2

| Potential Inactivating Substituents for The Reactive Groups |
|---|
| 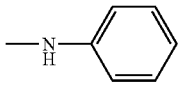 |
| 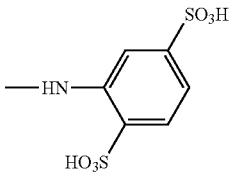 |
| 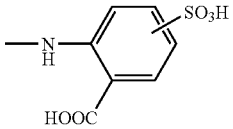 |
| 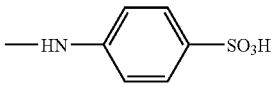 |
| 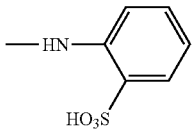 |
| 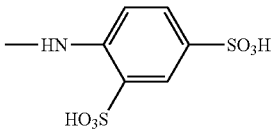 |
| 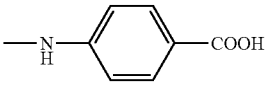 |
| 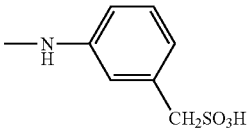 |
| 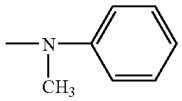 |

TABLE 2-continued

| Potential Inactivating Substituents for The Reactive Groups |
|---|
| 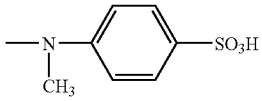 |
| —$NHCH_2CH_2OH$ |
| 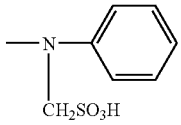 |
| 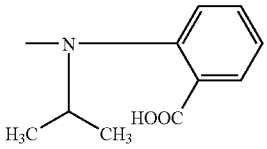 |
| —NH-alkylene-$SO_3H$ |
| —N-alkyl-alkylene-$SO_3H$ |
| 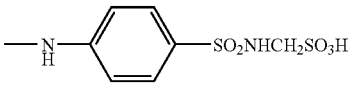 |
| 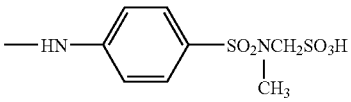 |

While only monochlorotriazines and monochlorodiazines are shown in Table 1, it is understood that monofluorotriazines and monofluorodiazines may also be used. It is also understood that dichlorodiazines and difluorodiazines may be used. Since these reactive groups are less reactive, they may be resistant to hydrolysis. Therefore, the shelf-life and stability of the cyan, yellow, magenta, blue, green, orange, gold, turquoise, etc. or black inkjet inks of the present invention are increased.

Remaining sites on the triazine or diazine group may be unsubstituted or substituted with at least one group including, but not limited to, amino, alkylamino, dialkylamino, arylamino, alkoxide, or aryloxide groups. These additional substituents may have an inactivating effect on the halogen of the reactive group, further reducing the reactivity of the reactive group and making the reactive colorant less susceptible to hydrolysis. For example, these substituents may include, but are not limited to, the substituents listed in Table 2.

If a triazine is used as the reactive group, the triazine may be linked to the dye with a non-imino bridge link or an imino-bridge link. In one embodiment, the reactive group is a mono-halogen triazine having an imino bridge link to the dye, as shown by the following formula:

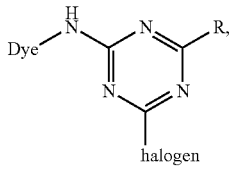

where R is an amine. In yet another embodiment, the amine is a dialkyl amine (such as —$N(CH_3)_2$, —$N(CH_2CH_3)_2$, or —$N(CH_2CH_2OH)_2$), a diaryl amine (such as —N-aryl), or a diamine substituted with an alkyl group and an aryl group, such as a mono-alkyl amine (—N-alkyl) and a mono-aryl amine (—N-aryl).

If a diazine is used as the reactive group, the diazine group may be linked to the dye by an imine, a sulfonamide, an oxy-, a thio-, an amide, or an azo bridge. Of these linkage groups, an imine bridge is preferable because it provides the least reactivity. In another embodiment, the reactive group is a dichloropyrimidine with an imino bridge link to the dye, as shown by the following formula:

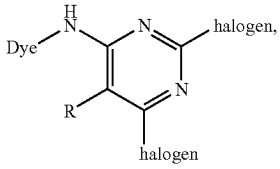

where R is an electron-withdrawing substituent or an electron-donating substituent, depending on the desired reactivity of the pyrimidine group. An electron-withdrawing substituent, such as a halide or a nitro group, may activate the pyrimidine while an electron-donating substituent, such as an alkyl or amine group, may further deactivate the pyrimidine group.

It is also contemplated that the reactive colorant may have more than one reactive group. If multiple reactive groups are present, all of the reactive groups may be similar (i.e. two monochlorotriazine groups) or at least one of the reactive groups may differ from the other reactive groups (i.e. one monochlorotriazine group and one sulphone group).

If the reactive colorant is a pigment, the pigment may be present in a range of approximately 0.1% to 20% by weight of the pigment based on the total weight of the inkjet ink. The chromophoric group of the pigment may be a quinacridone, phthalocyanine, benzimidazolone, insoluble azo, fused azo, quinophthalone, naphthol, perylene, imidazolone, or isoindolinone group. For the pigment to be sufficiently reactive to react with the activating agent, the reactive group previously described may be incorporated into the polymer resin. By increasing the reactivity of the pigment, a lower concentration of binder (approximately 5%) may be used, thereby making these pigment-based inks more suitable for use in inkjet printing.

The reactive colorant may be present in the inkjet ink in a sufficient amount to provide the printed ink with the desired color and color intensity. For instance, the reactive colorant may be present at approximately 0.1% to 15% by weight of the reactive colorant based on the total weight of the inkjet ink. Preferably, the reactive colorant is present at approximately 3-8% by weight. The reactive colorant may be dissolved, dispersed, or suspended in the ink vehicle, by conventional techniques, to formulate the inkjet ink.

The shelf life of the inkjet ink may be determined by monitoring the properties of the inkjet ink under normal storage conditions or under accelerated storage conditions, such as increased temperatures. For every 10° C. increase in temperature, an approximate two-fold increase is generally observed. For example, if the inkjet ink is stored for 2 weeks at 60° C., it approximates normal storage conditions of 32 weeks at 20° C. Similarly, storage for 5 weeks at 60° C. approximates 80 weeks at 20° C.

An inkjet printing system having an activating agent for use in combination with the reactive colorant is disclosed. The inkjet printing system may be used in drop-on-demand printing and thermal inkjet printing. The reactive colorant may be formulated into a cyan, yellow, magenta, blue, green, orange, gold, turquoise, etc. or black inkjet ink. When the activating agent and the reactive colorant come into contact with each other, the activating agent activates the reactive colorant and fixes the reactive colorant to a substrate.

The activating agent may be a compound that reacts with the reactive colorant to increase the reactivity of the reactive colorant and, in doing so, can fix the reactive colorant to the substrate at a lower temperature. Specifically, the activating agent may react with the reactive group of the reactive colorant. The activating agent may be a nucleophilic or ionizable compound, such as a tertiary amine. The activating agent may be a trialkylamine, pyridine, nicotinic acid, or a polymer containing a trialkylamine, pyridine, N,N-dimethylhydrazine, or nicotinic acid, where the polymer is firmly bound to the textile. Preferably, the activating agent is nicotinic acid, triethanolamine, or 1,4-diazabicyclo(2,2,2) octane ("DABCO").

The activating agent may initially be stored separately from the inkjet ink. Since the activating agent increases the reactivity of the reactive colorant, its inclusion in the inkjet ink would negatively affect the reactive colorant's susceptibility to hydrolysis, reducing the shelf life of the inkjet ink. The activating agent may be present in at least one pen of an inkjet printer or may be present on the substrate. If the activating agent is present in an inkjet pen, the activating agent may be formulated into a vehicle, similar to a conventional ink vehicle. The vehicle may include water and at least one water-soluble organic solvent. In addition, the vehicle may include optional ingredients, including, but not limited to, fillers, pH adjusters, or surfactants, depending on the desired properties of the vehicle. Preferably, the vehicle has a surface tension less than approximately 50 dynes/cm.

The activating agent may be dissolved or solubilized in the vehicle and stored in a dedicated pen in the inkjet printer. Formulating the activating agent in the inkjet pen may provide numerous advantages. For example, it may allow the activating agent to be easily used with fabrics that are difficult to fix with reactive dyes. In addition, the inkjet pen may be used to enhance color fixation at a preselected location on the textile. In other words, the inkjet pen having the activating agent may enhance chroma in the preselected location. The inkjet printer used herein may be a multiple-pen printer in which color (e.g., cyan, yellow, magenta, blue, green, orange, gold, turquoise, etc.) or black inkjet inks are stored in some of the pens and the activating agent is stored in any remaining pen. It is also contemplated that the color or black inkjet inks may be stored in one inkjet printer and the activating agent is stored in a second inkjet printer.

Alternatively, the activating agent may be present on the substrate, either coating or substantially saturating the substrate. The activating agent may be incorporated into the substrate during its formation or after the substrate has been formed. For example, the activating agent may be added to a starting material of the substrate, which is subsequently formed into the substrate. The activating agent may also be incorporated into the substrate after the substrate has been produced, by techniques known in the art. These techniques include, but are not limited to, continuous processes, application of the activating agent as a continuous film, padding, dipping, spraying, foam application, exhaust processes, or by using a rod, roll, flexopress, blade, or air-knife coater.

The activating agent may also be incorporated into the substrate during a pretreatment step. The pretreatment step uses a pretreatment composition having a base, such as sodium hydroxide or sodium carbonate, to convert hydroxyl groups on a cellulose backbone of a substrate to alkoxide groups. The activating agent may be easily added to the pretreatment composition. By using the activating agent in the pretreatment step, the printed substrate may ultimately be cured at approximately 100° C. Since the reactivity of the reactive colorant is decreased by modifying the reactive group, the reactive colorant may have to be cured at an impractical temperature, such as greater than approximately 140° C., if the activating agent was not present. However, by using the activating agent, the reactivity of the reactive group is increased and the reactive colorant may be cured at a practical temperature of approximately 100° C. Since the reactive groups may be cured at practical temperatures, the same equipment and curing conditions developed for printing on textiles may be used.

The substrate used in the present invention may be a paper, textile, polymeric film, cellulosic film, glass, metal, sintered metal, wood, carbon-based material, or ceramic material. Preferably, the substrate is a textile substrate. As used herein, as "textile" or "textile substrate" is a natural, synthetic, cellulose-based, or non-cellulose based textile material, or mixtures thereof, that is suitable for use in inkjet printing. The textile substrate may include, but is not limited to, a textile having hydroxyl group-containing fibers such as natural or regenerated cellulosic fibers, nitrogen group-containing fibers, natural or synthetic polyamides, and/or fibers with acid-modified polyester and polyamide groups. By way of example only, the textile substrate may be 100% cotton, a cotton/polyester blend, polyester, silk, rayon, wool, a polyamide, nylon, an aramid, acrylic, modacrylic, a polyolefin, spandex, saran, linen, hemp, jute, sisal, latex, butyl rubber, vinyl, polyacrylonitrile, and polyamide fiber. Preferably, the textile substrate is cotton, a cotton blend, wool, or silk, or a blend thereof. It is also contemplated that the textile substrate may have polymers added thereto or may include a backing to facilitate feeding of the textile through the inkjet printer.

The size of the textile substrate is not critical to the invention and, therefore, may vary depending on the application. The textile substrate may be sized before or after application of the inkjet ink and/or activating agent. In addition, the inkjet ink and/or activating agent may be applied in an external sizing process so that a single step may be used.

To produce a desired image on the textile substrate, the activating agent and the reactive colorant may be brought into contact with each other. When the activating agent is present in the inkjet pen, the reactive colorant and activating agent may contact each other when they are both applied to, or printed on, the textile substrate. The activating agent may be over- or under-printed relative to the inkjet ink. Alternatively, the activating agent and reactive colorant may come into contact when the inkjet ink is printed on the textile substrate that already contains the activating agent.

When the activating agent and the reactive colorant come into contact, they may react to form a covalent, electrostatic, or ionic complex. This complex is more reactive towards the alkoxide or hydroxyl groups on the textile substrate than the reactive colorant alone. The complex then reacts with the textile substrate. Since the reactivity of the reactive colorant is increased, the yield of the reactive colorant fixing to the textile substrate is improved.

The overall reaction of the activating agent and reactive colorant with the textile substrate is a nucleophilic addition and elimination reaction. The tertiary amine of the activating agent adds to the reactive colorant, replacing the halogen atom, to form a quaternary nitrogen leaving group. The quaternary nitrogen leaving group is eliminated when the complex of the activating agent and reactive colorant reacts with the alkoxide or hydroxyl groups on the textile substrate to form a covalent bond between the reactive colorant and textile substrate. Preferably, a covalent bond is formed between a carbon atom on the reactive colorant and an oxygen or nitrogen atom on the textile substrate to fix the reactive colorant to the textile substrate.

The quaternary nitrogen leaving group that is eliminated during the reaction may be converted back into a tertiary amine (the activating agent). Therefore, catalytic amounts of the activating agent may be all that is necessary to increase the reactivity of the reactive colorant. However, it is also contemplated that stoichiometric amounts of the activating agent may be used. For example, a stoichiometric amount of the activating agent may be used so that only a portion of the reactive colorant is activated and fixed to the textile substrate. The remaining portion may be washed out during subsequent washing steps. This allows a reduced amount of the reactive colorant to be fixed on the fabric, which is desirable when reduced chroma is needed because the available color space is increased.

To print the desired image, the activating agent and reactive colorant may be applied to the textile substrate at approximately a 1:10 mixture (activating agent:reactive colorant) on a molar basis. When the activating agent is applied to the textile substrate using the inkjet pen, the activating agent may be present in the vehicle at approximately 0.1-3 wt %. Preferably, the activating agent is present at approximately 0.3-0.8 wt %. When the activating agent is incorporated into the textile substrate, the activating agent may be present at approximately 0.1-10 grams/yard of textile substrate.

After both the activating agent and the reactive colorant are applied to the textile substrate, the textile substrate may be heated and/or steamed to further fix the reactive colorant onto the substrate. The substrate may then be washed to remove any unfixed colorant.

EXAMPLES

Example 1

Composition of an Inkjet Ink Having Monochlorotriazine

An inkjet ink having monochlorotriazine as the reactive group is formulated. The monochlorotriazine is present in the inkjet ink at 3-8% by weight and is formulated into the ink vehicle, which comprises 10% 1,2 hexanediol, 4% 2-pyrrolidinone, 0.2% proxel, and 0.3% MES (adjusted to pH 6.5). The monochlorotriazine reactive group is attached to the chromophore through an imino group. To obtain a yellow inkjet ink, the chromophore of Compound I is used. To obtain a red inkjet ink, the chromophore of Compound II is used. To obtain a turquoise inkjet ink, the chromophore of Compound X is used. To obtain a black inkjet ink, the chromophore of Compound VIII is used. Other colors of inkjet inks are obtained by using different chromophores, as known in the art. The pH of the inkjet ink is adjusted to approximately 6.0-6.5 by the addition of a suitable buffer.

Example 2

Composition of an Inkjet Ink Having Monofluorotriazine

An inkjet ink as described in Example 1 is formulated, except that the reactive group is monofluorotriazine.

Example 3

Composition of an Inkjet Ink Having Monochlorodiazine

An inkjet ink as described in Example 1 is formulated, except that the reactive group is monochlorodiazine.

Example 4

Composition of an Inkjet Ink Having Monochloropyrimidine

An inkjet ink as described in Example 1 is formulated, except that the reactive group is monochloropyrimidine.

Example 5

Composition of an Inkjet Ink Having Difluoropyrimidine

An inkjet ink as described in Example 1 is formulated, except that the reactive group is difluoropyrimidine.

Example 6

The Shelf Life of the Inkjet Ink Having Monochlorotriazine

The shelf life of the inkjet ink described in Example 1 is determined by storing the inkjet ink in a glass bottle in an oven. The inkjet ink is exposed to a temperature of approximately 60° C. for five weeks to approximate normal storage conditions of 20° C. for 80 weeks (approximately 20 months). The shelf life is greater than approximately twelve months.

Example 7

The Shelf Life of the Inkjet Ink Having Monofluorotriazine

The shelf life of the inkjet ink described in Example 2 is determined. The shelf life is greater than approximately twelve months.

Example 8

The Shelf Life of the Inkjet Ink Having Monochlorodiazine

The shelf life of the inkjet ink described in Example 3 is determined. The shelf life is greater than approximately twelve months.

Example 9

The Shelf Life of the Inkjet Ink Having Monochloropyrimidine

The shelf life of the inkjet ink described in Example 4 is determined. The shelf life is greater than approximately twelve months.

Example 10

The Shelf Life of the Inkjet Ink Having Difluoropyrimidine

The shelf life of the inkjet ink described in Example 5 is determined. The shelf life is greater than approximately twelve months.

Example 11

Inkjet Printing System using DABCO Incorporated into a Cotton Substrate

Each of the inkjet inks described in Examples 1-5 is printed on a cotton substrate using a drop-on-demand or thermal inkjet printer. The cotton substrate includes approximately 0.1-10 grams of DABCO per yard of cotton. The DABCO activates the reactive colorants in each of the inkjet inks so that the reactive colorants are fixed to the cotton substrate.

Example 12

Inkjet Printing System using DABCO in an Inkjet Pen

Each of the inkjet inks described in Examples 1-5 is printed on a cotton substrate. The inkjet inks are used in a drop-on-demand or thermal inkjet printer. Approximately 0.1-3% by weight DABCO is present in a vehicle in an inkjet pen. The DABCO is printed on the cotton substrate, either by over- or under-printing. The DABCO activates the reactive colorants in each of the inkjet inks so that the reactive colorants are fixed to the cotton substrate.

What is claimed is:

1. An inkiet printing system comprising:

an activating agent comprising triethanolamine, 1,4-diazabicyclo(2,2,2)octane, pyridine, or nicotinic acid; and an inkiet ink comprising an aqueous ink vehicle and a reactive colorant comprising at least one reactive group selected from the group consisting of a monochlorodiazine, a monofluorodiazine, a dichlorodiazine, a monofluoropyrimidine, a dichloropyrimidine, a trifluoropyrimidine, a derivative of a monochlorodiazine, a derivative of a monofluorodiazine, a derivative of a dichlorodiazine, a derivative of a monofluoropyrimidine, a derivative of a dichloropyrimidine, a derivative of a trifluoropyrimidine, and a derivative of a trichloropyrimidine, the aqueous ink vehicle comprising at least one water-soluble organic solvent selected from the group consisting of an aliphatic alcohol, an aromatic alcohol, a diol, a glycol ether, a poly(glycol) ether, a long chain alcohol, and mixtures thereof, wherein the at least one reactive group and the activating agent react to form a complex.

2. The inkjet printing system of claim 1, wherein the inkjet ink has a pH ranging from approximately 6.0 to approximately 6.5.

3. The inkjet printing system of claim 1, wherein the reactive colorant exhibits less than approximately 10% hydrolysis over a twelve month period.

4. A method of printing on a textile substrate comprising:

applying an activating agent comprising triethanolamine, 1,4-diazabicyclo (2,2,2)octane, pyridine, or nicotinic acid to a textile substrate;

applying an inkiet ink to the textile substrate, the inkjet ink comprising an aqueous ink vehicle and a reactive colorant comprising at least one reactive group selected from the group consisting of a monochlorodiazine, a monofluorodiazine, a dichlorodiazine, a monofluoropyrimidine, a dichloropyrimidine, a trifluoropyrimidine, a derivative of a monochlorodiazine, a derivative of a monofluorodiazine, a derivative of a dichlorodiazine, a derivative of a monofluoropyrimidine, a derivative of a dichloropyrimidine, a derivative of a trifluoropyrimidine, and a derivative of a trichloropyrimidine, the aqueous ink vehicle comprising at least one water-soluble organic solvent selected from the group consisting of an aliphatic alcohol, an aromatic alcohol, a diol, a glycol ether, a poly(glycol) ether, a lone chain alcohol, and mixtures thereof;

forming a complex between the activating agent and the at least one reactive group to activate the at least one reactive group; and fixing the reactive colorant to the textile substrate.

5. The method of claim 4, wherein applying the triethanolamine, 1,4-diazabicyclo(2,2,2)octane, pyridine, or nicotinic acid to the textile substrate comprises coating the textile substrate with the triethanolamine, 1,4-diazabicyclo (2,2,2)octane, pyridine, or nicotinic acid or substantially saturating the textile substrate with the triethanolamine, 1,4-diazabicyclo(2,2,2)octane, pyridine, or nicotinic acid.

6. The method of claim 4, wherein applying the activating agent to the textile substrate comprises printing the activating agent on the textile substrate using an inkiet pen.

7. The method of claim 4, wherein applying the activating agent to the textile substrate comprises incorporating the activating agent into a starting material of the textile substrate or incorporating the activating agent into a formed textile substrate.

8. The method of claim 4, wherein the textile substrate is cotton, a cotton blend, wool, or silk, or a blend thereof.

9. The method of claim 4, wherein applying the inkjet ink to the textile substrate comprises applying an inkjet ink having a pH that ranges from approximately 6.0 to approximately 6.5 to the textile substrate.

10. The method of claim 4, wherein applying the inkjet ink to the textile substrate comprises applying an inkiet ink having a shelf life of between approximately eighteen months and approximately twenty four months to the textile substrate.

11. The inkiet ink of claim 1, wherein the reactive colorant exhibits less than approximately 10% hydrolysis over a twelve month period.

12. An inkjet printing system comprising:

an activating agent; and an inkjet ink comprising an aqueous ink vehicle and a reactive colorant comprising at least one reactive group selected from the group consisting of a monochlorotriazine, a monofluorotriazine, a monochlorodiazine, a monofluorodiazine, a dichlorodiazine, a monofluoropyrimidine, a monochloropyrimidine, a difluoropyrimidine, a dichloropyrimidine, a trifluoropyrimidine, a trichloropyrimidine, a derivative of monochlorotriazine, a derivative of monofluorotriazine, a derivative of monochlorodiazine, a derivative of monofluorodiazine, a derivative of dichlorodiazine, a derivative of monofluoropyrimidine, a derivative of monochloropyrimidine, a derivative of difluoropyrimidine, a derivative of dichloropyrimidine, a derivative of trifluoropyrimidine, and a derivative of trichloropyrimidine, the aqueous ink vehicle comprising at least one water-soluble organic solvent selected from the group consisting of an aliphatic alcohol, an aromatic alcohol, a diol, a glycol ether, a poly(glycol) ether, a long chain alcohol, and mixtures thereof.

13. The inkjet printing system of claim 12, wherein the activating agent is triethanolamine, 1,4-diazabicyclo[2,2,2] octane, pyridine, or nicotinic acid.

14. The inkjet printing system of claim 12, wherein the inkjet ink has a pH of approximately 6.0-6.5.

15. The inkjet printing system of claim 12, wherein the reactive colorant exhibits less than approximately 10% hydrolysis over a twelve month period.

16. The inkjet printing system of claim 12, wherein the at least one reactive group includes at least one moiety selected from a group consisting of: amino, alkylamino, dialkylamino, arylamino, alkoxide, and aryloxide groups.

* * * * *

UNITED STATES PATENT AND TRADEMARK OFFICE

CERTIFICATE OF CORRECTION

PATENT NO. : 7,294,183 B2
APPLICATION NO. : 10/280342
DATED : November 13, 2007
INVENTOR(S) : David Tyvoll It is certified that error appears in the above-identified patent and that said Letters Patent is hereby corrected as shown below:

In column 5, lines 15-18, delete " ]$_{2}$ " and insert -- ]$_{2-3}$ --, therefor.

In column 14, line 55, in Claim 1, delete "inkiet" and insert -- inkjet --, therefor.

In column 14, line 58, in Claim 1, delete "inkiet" and insert -- inkjet --, therefor.

In column 15, line 18, in Claim 4, delete "inkiet" and insert -- inkjet --, therefor.

In column 15, line 33, in Claim 4, delete "lone" and insert -- long --, therefor.

In column 15, line 47, in Claim 6, delete "inkiet" and insert -- inkjet --, therefor.

In column 16, line 8, in Claim 10, delete "inkiet" and insert -- inkjet --, therefor.

In column 16, line 12, in Claim 11, delete "inkiet" and insert -- inkjet --, therefor.

Signed and Sealed this

Eighteenth Day of May, 2010

David J. Kappos

David J. Kappos
*Director of the United States Patent and Trademark Office*